US009816333B2

(12) United States Patent
Lovell

(10) Patent No.: US 9,816,333 B2
(45) Date of Patent: Nov. 14, 2017

(54) METHOD AND APPARATUS FOR STABBING OF PIPE AND OTHER TUBULAR GOODS

(71) Applicant: BESCO TUBULAR, Houma, LA (US)

(72) Inventor: Jamie Lovell, Houma, LA (US)

( * ) Notice: Subject to any disclaimer, the term of this patent is extended or adjusted under 35 U.S.C. 154(b) by 243 days.

(21) Appl. No.: 14/720,120

(22) Filed: May 22, 2015

(65) Prior Publication Data

US 2015/0337608 A1 Nov. 26, 2015

Related U.S. Application Data

(60) Provisional application No. 62/002,234, filed on May 23, 2014.

(51) Int. Cl.

| | |
|---|---|
| ***E21B 19/06*** | (2006.01) |
| ***E21B 19/16*** | (2006.01) |
| ***E21B 19/24*** | (2006.01) |
| ***E21B 19/02*** | (2006.01) |
| ***E21B 19/086*** | (2006.01) |

(52) U.S. Cl.
CPC ..... *E21B 19/06* (2013.01); *E21B 19/02* (2013.01); *E21B 19/086* (2013.01); *E21B 19/16* (2013.01); *E21B 19/24* (2013.01)

(58) Field of Classification Search
CPC ..... E21B 19/06; E21B 19/02; E21B 19/086; E21B 19/16; E21B 19/24
USPC ..... 166/77.52
See application file for complete search history.

(56) References Cited

U.S. PATENT DOCUMENTS

2005/0279507 A1* 12/2005 Folk ..... E21B 19/08 166/378
2014/0131051 A1* 5/2014 Pratt ..... E21B 19/06 166/380

* cited by examiner

*Primary Examiner* — Taras P Bemko
(74) *Attorney, Agent, or Firm* — Ted M. Anthony

(57) ABSTRACT

A weight compensating pipe stabbing assembly utilizes bail mounting members operationally attached to bail members of a drilling rig. At least one compensation cylinder is mounted to each bail mounting member, while a cable or other linkage member extends from each cylinder assembly to a set of single joint elevators.

6 Claims, 7 Drawing Sheets

METHOD AND APPARATUS FOR STABBING OF PIPE AND OTHER TUBULAR GOODS

CROSS REFERENCES TO RELATED APPLICATIONS

Priority of U.S. Provisional Patent Application Ser. No. 62/002,234, filed May 23, 2014, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to pipe connection and disconnection operations. More particularly, the present invention pertains to a weight compensator for use during pipe installation and removal operations. More particularly still, the present invention pertains to a bail assisted assembly for stabbing and connection of tubular members in oil and/or gas wells or other applications.

2. Brief Description of the Prior Art

Pipe and/or other tubular goods are typically installed in oil and/or gas wells for a variety of reasons. In many instances, such pipe and/or tubular goods are inserted into a well in a number of separate sections of substantially equal length called "joints", or combinations of joints called "stands", using a drilling rig or other equipment located at the earth's surface. The pipe sections are typically joined end to end using threaded connections to form a continuous length of pipe that extends downward into a well.

As part of the pipe installation process, a first segment of pipe is partially inserted within the upper opening of a wellbore and suspended or hung in place using slips positioned at or near the rig floor. Thereafter, an additional section of pipe is added to the upper end of said suspended first section, and the joined pipe string is then partially lowered deeper into said wellbore. The process is repeated until the overall pipe string has a desired length that extends a desired distance into said wellbore.

When a string of pipe is suspended within a wellbore, a portion of the uppermost section of pipe protrudes out of the upper opening of the well and extends a desired distance above said rig floor and slips. A threaded connection (according to industry convention, typically a female or "box end" threaded connection) is positioned at the upper end of said section of pipe and faces upward for receiving a mating threaded connection from another section of pipe that is to be joined to said string.

Thereafter, a separate section of pipe is typically lifted within a drilling rig derrick using a top drive unit or other hoisting equipment, and suspended vertically within said derrick. Said separate section of pipe is then lowered toward said suspended pipe string until a threaded connection (typically a male or "pin end" threaded connection) at the lower end of said separate section of pipe is stabbed into said threaded connection located on the upper end of said pipe string. In this position, torque can be applied to one or both of said pipe sections in order to join or "make-up" said threaded connection members.

Skill is required to lower said separate pipe section into position to make a threaded connection with the uppermost section of the pipe string suspended in the wellbore. If the separate pipe section is positioned too high above the box end connection of the suspended pipe string, the mating threads will not engage each other. Conversely, if the separate section is lowered too far, the full weight of said section may rest on the threaded connection of the suspended pipe string and damage may occur; further, even if damage does not occur, lowering of said separate pipe section too far can make maneuvering or manipulation of said section difficult.

As a result, during the pipe stabbing and connection process, mating pipe sections/strings should ideally be axially aligned with one another, and the weight of said separate (hanging within a rig derrick) section of pipe should beneficially be compensated or offset to prevent thread galling, cross threading or other improper connection.

Unfortunately, conventional pipe compensation systems do not permit precise alignment between said pipe sections, while compensating for the weight of pipe sections hanging within a derrick. Moreover, said conventional pipe compensation systems do not permit optimal positioning and maneuvering during pipe stabbing and connection operations.

SUMMARY OF THE INVENTION

The present invention comprises bail assisted "thread saver" assembly including an integrated mounting system that, once installed, incorporates all accessories necessary to compensate weight of a single joint or stand (multiple joints) of tubing, casing or other pipe. The present invention comprises a plurality of bail mounting members that are operationally attached to bail members on a drilling rig; said bail members, which are common components on most conventional drilling rigs, serve as linkage members between a hoisting mechanism and conventional elevators. At least one compensation cylinder is mounted to each bail mounting member, and a cable or other linkage member extends from each cylinder assembly to a set of single joint elevators.

The present invention prevents cables and cylinders from becoming tangled within a top drive system, allowing for safer pipe installation (running) or withdrawal (pulling) operations. The present invention further allows for true vertical alignment by maintaining a standard position during makeup and breakout of tubular goods, and eliminates any excess weight being applied to a threaded connector during makeup or breakout operations.

The present invention is compatible with any size bails and is capable of using a single fluid operated or powered cylinder (that is, one cylinder per side or per bail) lifting system which eliminates the need to rig up multiple cylinders, such as in a derrick. Further, the present invention is installed directly onto bails, equally distributing weight around a loop or eye of a bail, thereby stabilizing the present invention during pipe running or pulling operations.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

In a preferred embodiment, the present invention comprises a plurality of bail mounting members that are each operationally attached to a bail member on a drilling rig. At least one compensation cylinder is mounted to each bail mounting member, while a cable or other linkage member extends from each cylinder assembly to a set of single joint elevators that can be used to grip a section of pipe or other tubular.

Figure 1:
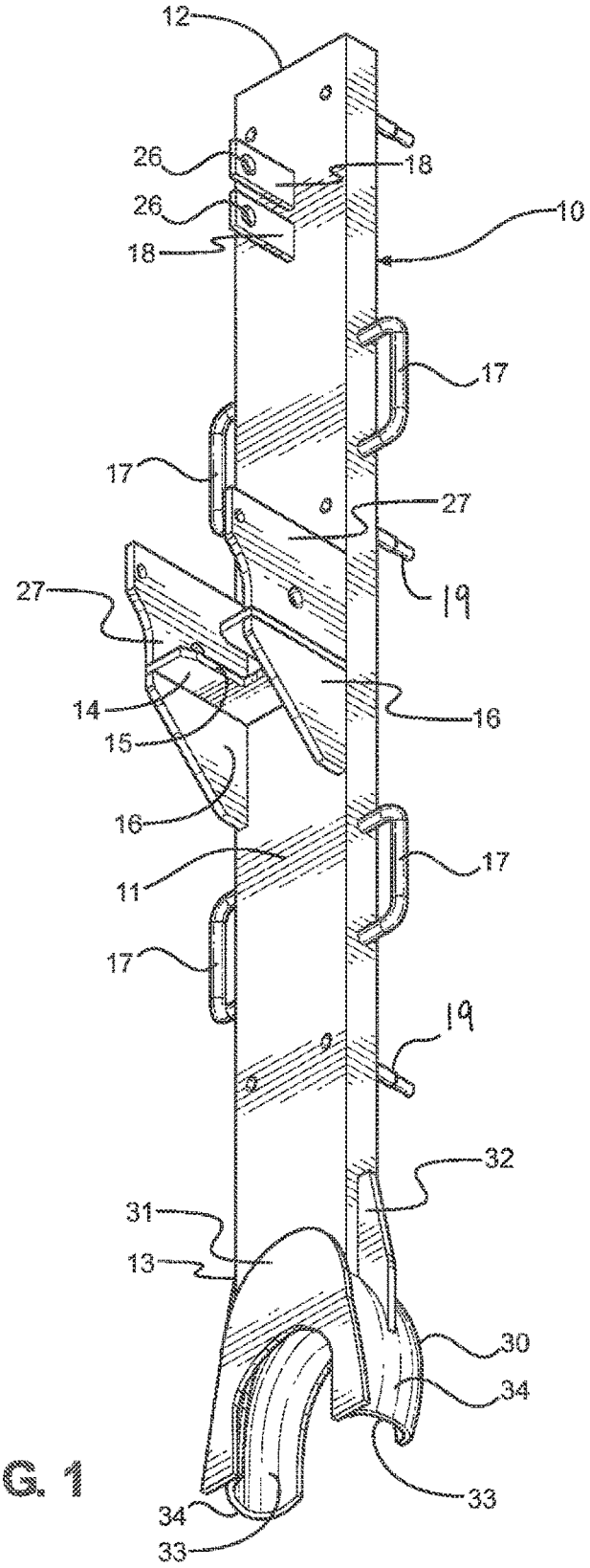
FIG. 1 depicts a side perspective view of a bail mounting member of the present invention.

Referring to the drawings, FIG. 1 depicts a side perspective view of a bail mounting member 10 of the present invention. In a preferred embodiment, said bail mounting member 10 comprises substantially planar body member 11 having upper end 12 and lower end 13. Cylinder support plate 14 having keyway slot 15 is disposed on one side of said body member 11 and projects outward from said body member 11. Side support brace members 16 provide structural support for cylinder support plate 14.

Still referring to FIG. 1, pad-eyes 18 extend from one side of body member 11; as depicted in FIG. 1, said pad-eyes 18 can be separate members, or a single combined member. Each pad-eye 18 has eyelet 26. Optional bolt extensions 19 protrude from body member 11, on the opposite side of said body member 11 from cylinder support plate 14. A plurality of handle members 17 also extend in spaced relationship along the length of body member 11.

Cup-like support shoulder member 30 is disposed at lower end 13 of body member 11. Said support shoulder member 30 forms a receptacle having opposing lateral extensions 34 that diverge away from body member 11. In a preferred embodiment, said lateral extensions 34 have generally inwardly/downwardly facing curved or concave inner surfaces 33. Face plate 31 is mounted on the front face of support shoulder member 30, while support members 32 (only one is visible in FIG. 1) provide structural support for lateral extensions 34.

Figure 2:
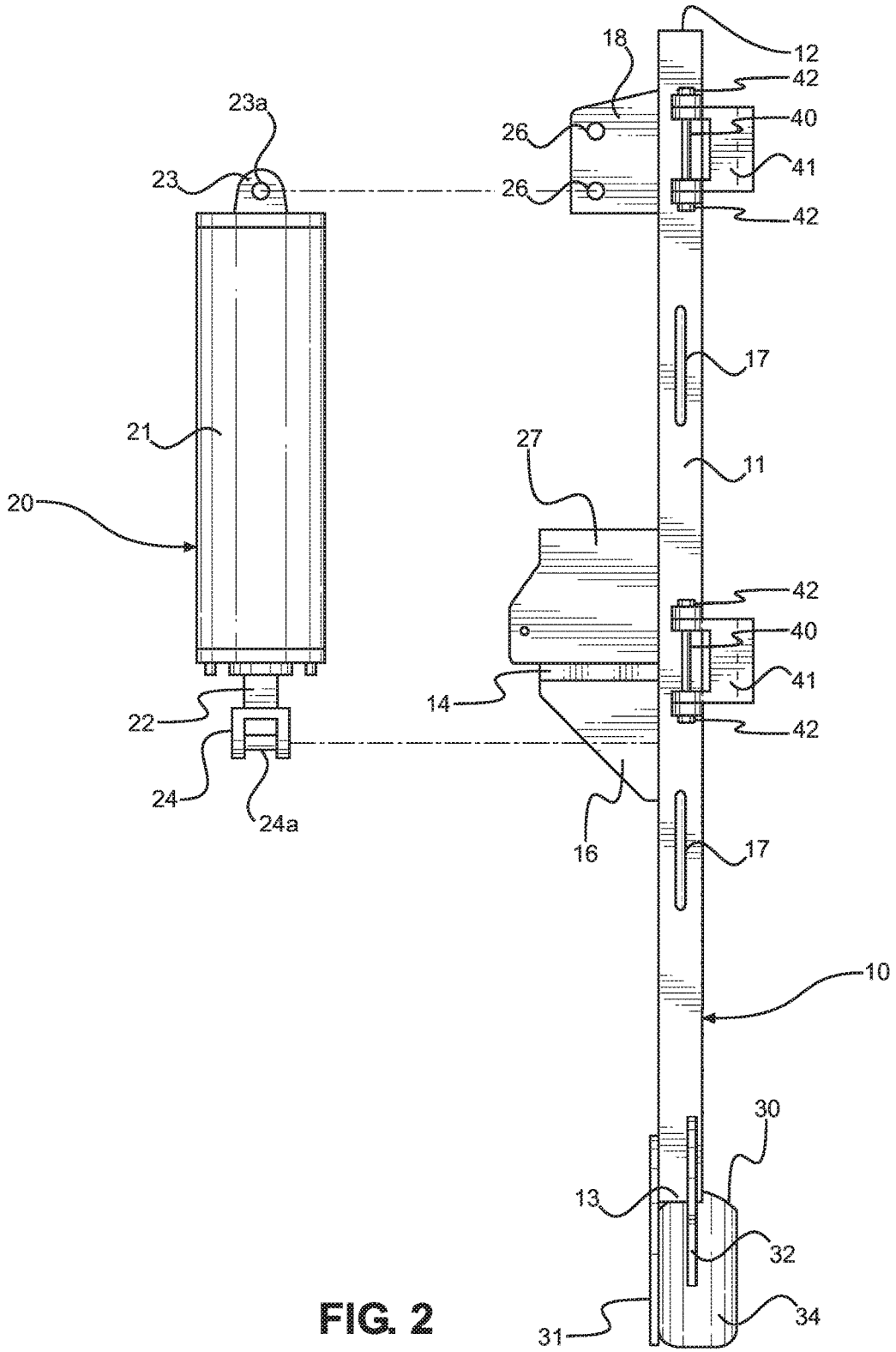
FIG. 2 depicts a side exploded view of a bail mounting member and compensator cylinder of the present invention.

FIG. 2 depicts a side exploded view of a bail mounting member 10 and compensator cylinder assembly 20 of the present invention. Bail mounting member 10 comprises substantially planar body member 11 having upper end 12 and lower end 13. Cylinder support plate 14 is disposed on one side of said body member 11 and projects outward from said body member 11. Side support brace member 16 provides structural support for cylinder support plate 14, while side plate members 27 are disposed on both sides of cylinder support plate 14.

Pad-eye member 18 having eyelets 26 extend from one side of body member 11. A plurality of handles 17 are positioned in spaced relationship along the length of body member 11. In the embodiment depicted in FIG. 2, mounting bracket pins 40 are attached to body member 11 using mounting pin support brackets 42. A mounting clamp member 41 is attached to each mounting pin 40. Support shoulder member 30 having lateral extension 34 is disposed at lower end 13 of body member 11. Face plate 31 is mounted on the front face of support shoulder member 30, while support member 32 provides strength and structural support for lateral extension 34.

Still referring to FIG. 2, compensator assembly 20 comprises a fluid powered cylinder having barrel 21 and piston rod 22. It is to be observed that piston rod 22 can slidably extend and retract relative to barrel 21. Barrel bracket 23 having eyelet **23*a* is disposed on barrel 21, while rod bracket 24 having bracket bolt 24*a* is disposed at the distal end of piston rod 22. Side plate members 27 (only one is visible in FIG. 2) are disposed on both sides of cylinder support plate 14. In many installations, it is to be observed that fluid powered cylinder of compensator assembly 20** is typically powered using air or gas.

Figure 3:
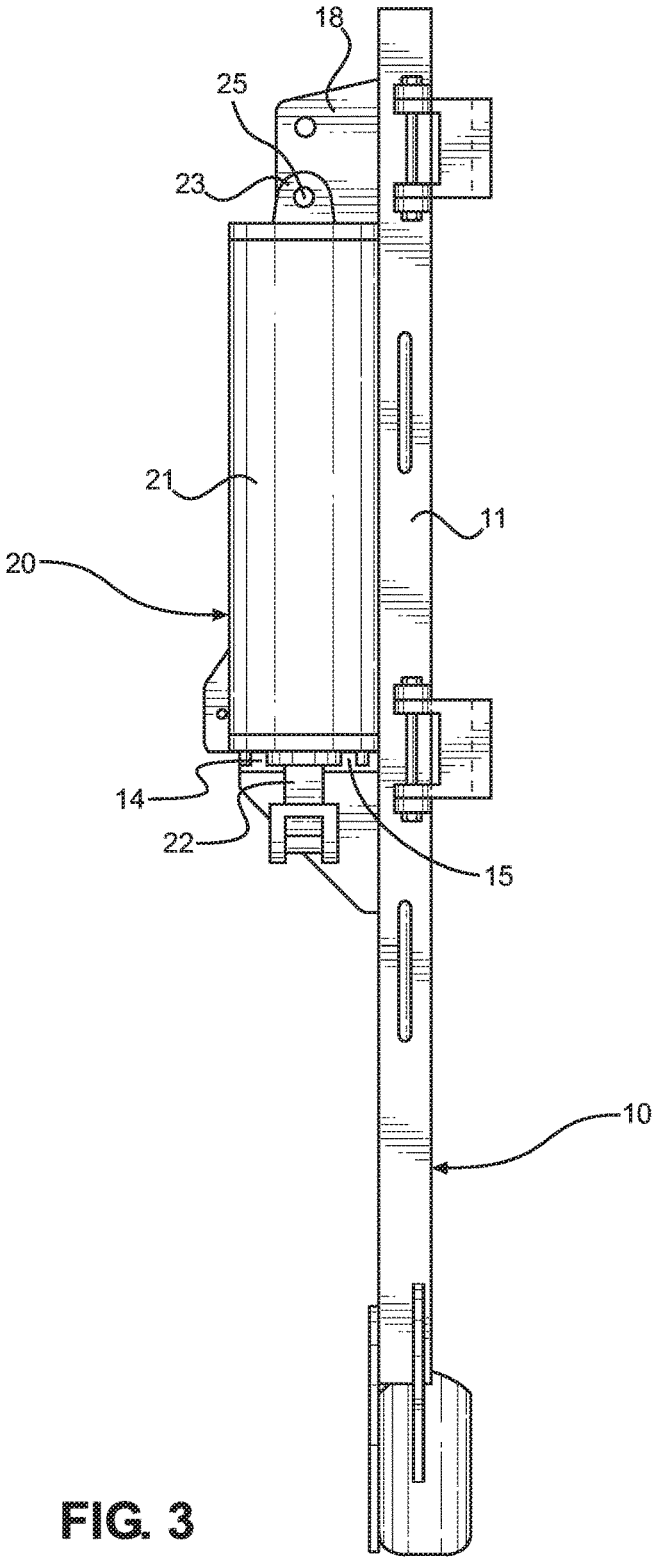
FIG. 3 depicts a side view of a bail mounting member and compensator cylinder of the present invention.

FIG. 3 depicts a side partial sectional view of a bail mounting member 10 with compensator cylinder assembly 20 of the present invention mounted thereto. As shown in FIG. 3, barrel bracket 23 is operationally attached to pad-eye 18 using anchor bolt 25. The base of cylinder barrel 21 is disposed on cylinder support plate 14, with piston rod 22 disposed within keyway slot 15. In this manner, piston rod 22 can extend or retract relative to barrel member 21 in a direction substantially parallel to the longitudinal axis of body member 11.

Figure 4:
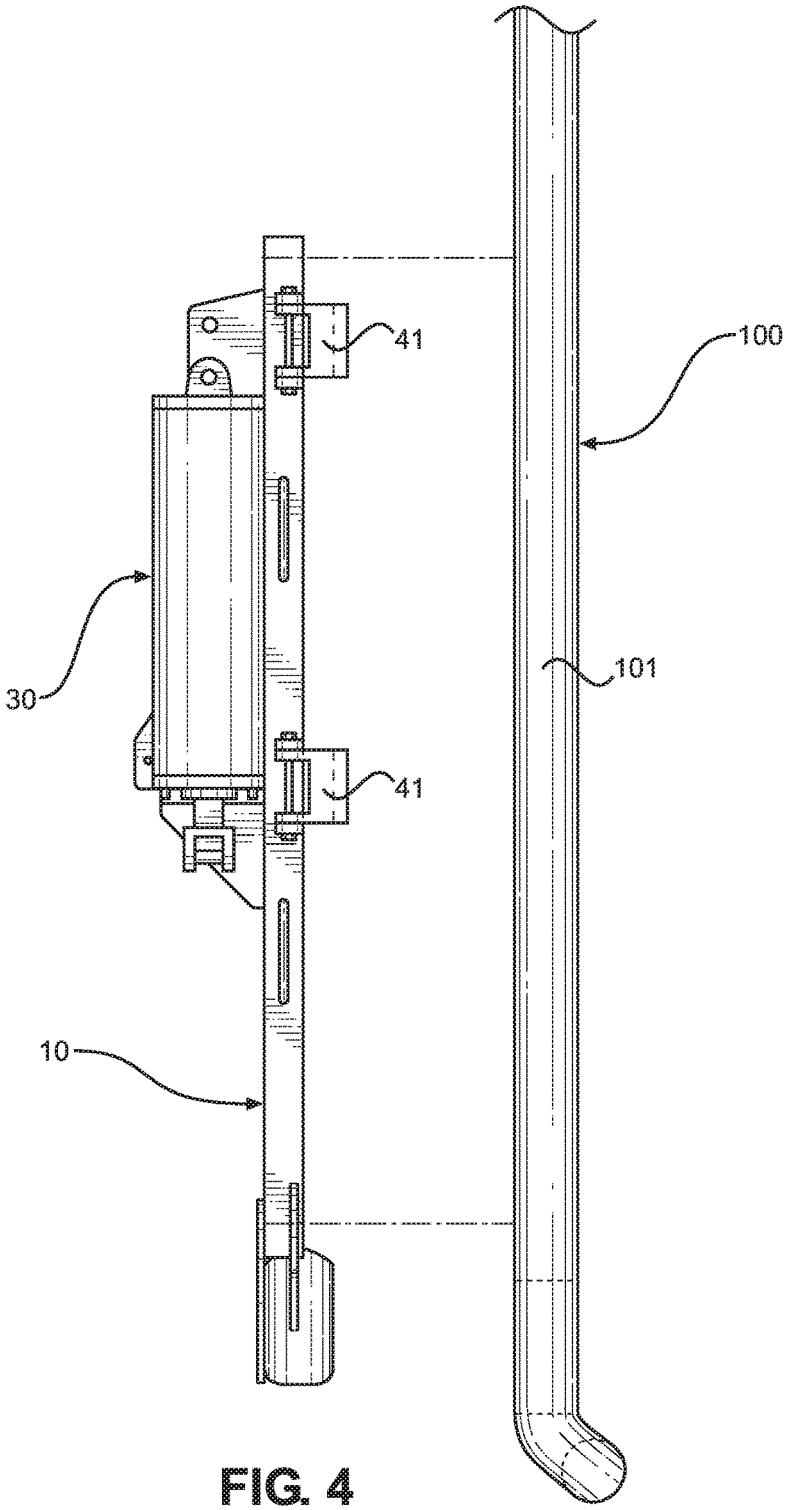
FIG. 4 depicts a side view of a bail mounting member and compensator cylinder of the present invention mounted to a bail member.

FIG. 4 depicts a side exploded view of a bail mounting member 10 (with compensator cylinder assembly 20 mounted thereto) operationally attachable to a bail member 100. As depicted in FIG. 4, bail mounting member 10 is securely attached to body section 101 of bail member 100 using mounting clamp members 41. In this configuration, the respective longitudinal axes of bail mounting member 10 and body section 101 of bail member 100 are oriented substantially in parallel alignment with each other.

Figure 5:
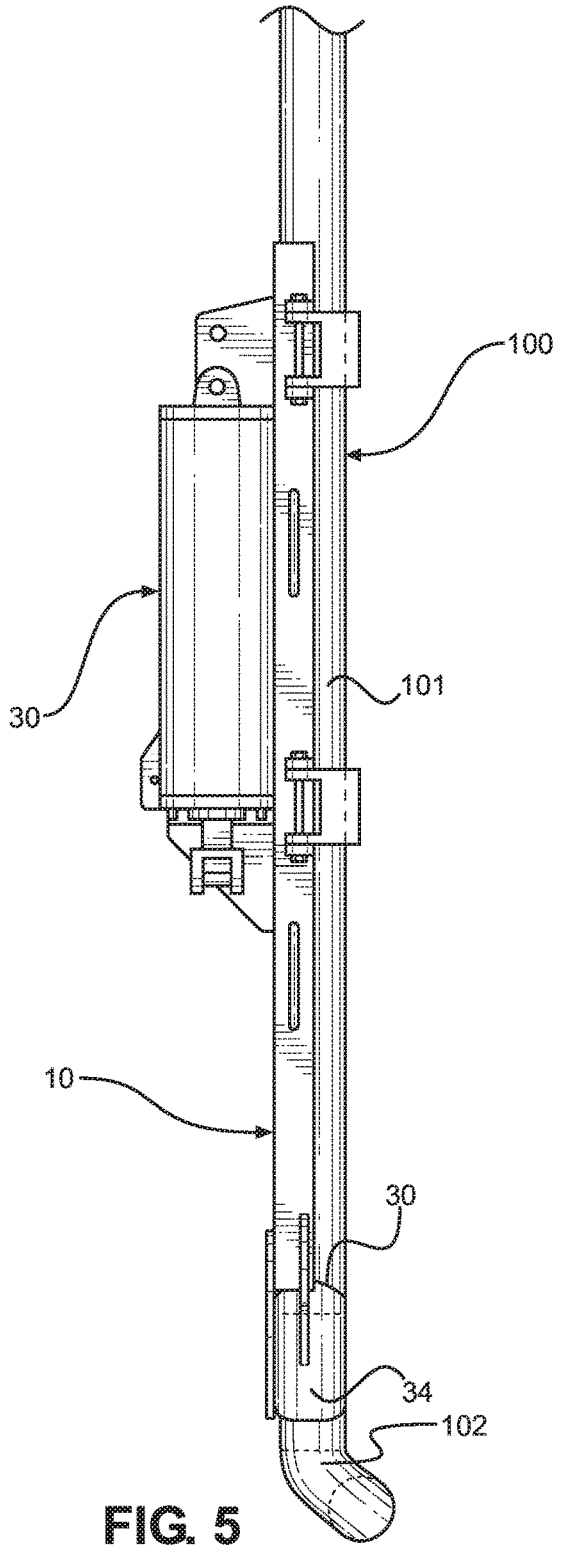
FIG. 5 depicts a side exploded view of a bail mounting member and compensator cylinder of the present invention with a bail member.

FIG. 5 depicts a side view of a bail mounting member 10 (with compensator cylinder assembly 20 mounted thereto) mounted to a bail member 100. Although the specific configuration of bail member 100 can vary depending upon rig parameters and design preferences, bail member 100 is depicted as an elongate linkage member having a substantially cylindrical body section 101 and an eye or loop 102 disposed at the lower end of said body section 101 (that is, at the bottom of bail member 100). Generally, bail member 100 serves as a linkage to operationally connect a drilling rig's lifting equipment (such as a top drive unit or traveling block) to a set of elevators or other desired gripping component.

Additionally, cup-like support shoulder member 30 forms a receptacle that is disposed generally over a portion of eye or loop 102 formed at the base of body section 101 of bail member 100. Specifically, opposing lateral extensions 34 each fit over and rest upon the upper portion of said bail loop 102. Generally inwardly/downwardly facing curved inner surfaces 33 (not visible in FIG. 5) substantially conform to the curved outer surface of said loop 102. In this manner, downward axial forces or loading acting on bail mounting member 10 are transferred to said loop 102 of bail 100; as a result, bail mounting member 10 is fully supported by bail member 100 including, without limitation, when axial forces acts on said bail mounting member 10.

Figure 6:
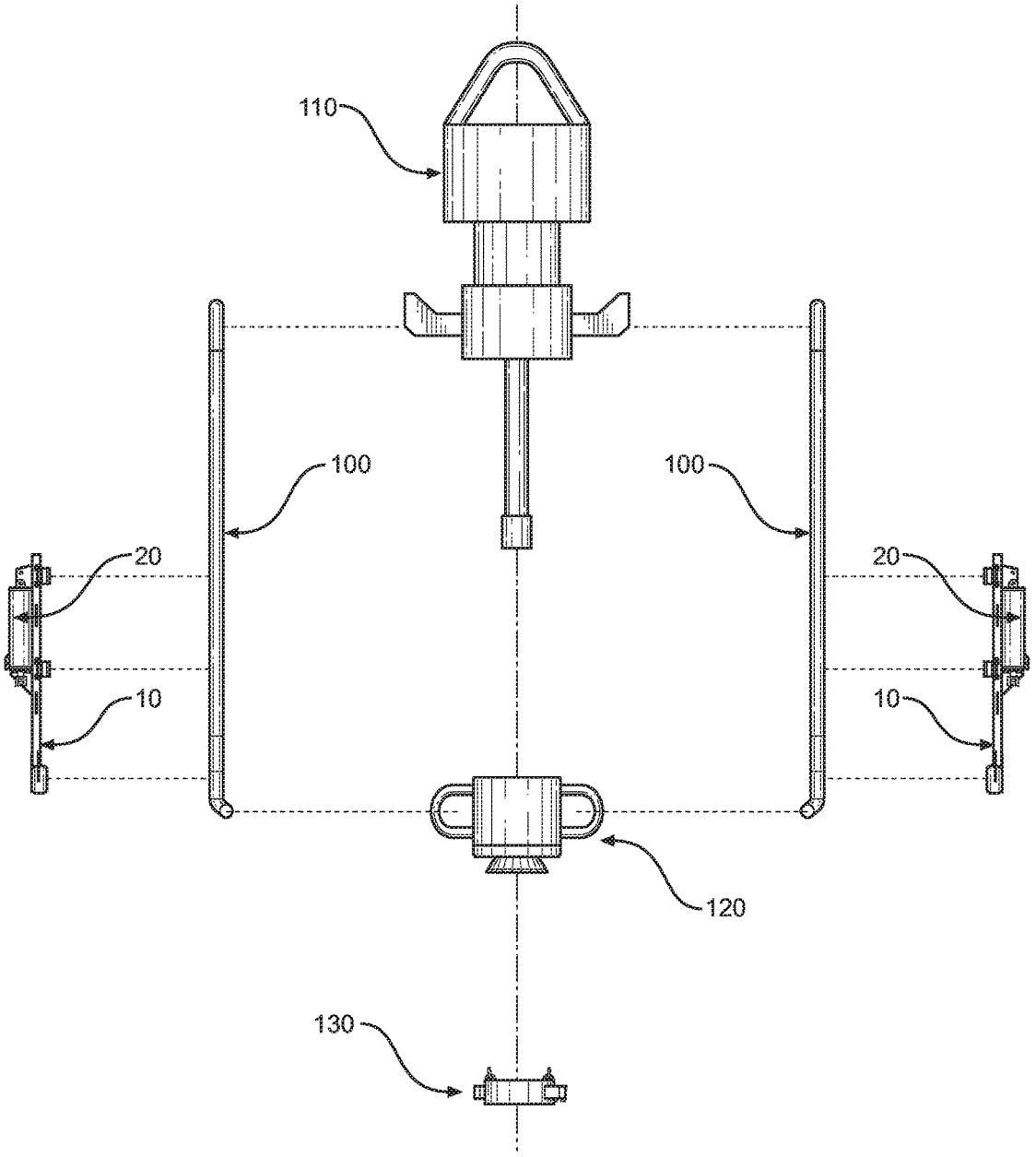
FIG. 6 depicts an exploded view of bail mounting members of the present invention with a top drive unit of a drilling rig.

FIG. 6 depicts an exploded side view of bail mounting members 10 of the present invention with a top drive unit of a drilling rig. Specifically, referring to FIG. 6, top drive unit 110 is mounted within a drilling rig derrick and provides lifting capacity for lifting/support of pipe and other equipment in and out of a wellbore. Bail members 100 serve as linkage members between top drive unit 110 and elevators 120. Bail mounting members 10 can be mounted to bail members 100, while cables (not pictured in FIG. 6) extend from cylinder assemblies 20 to single joint elevator 130.

Figure 7:
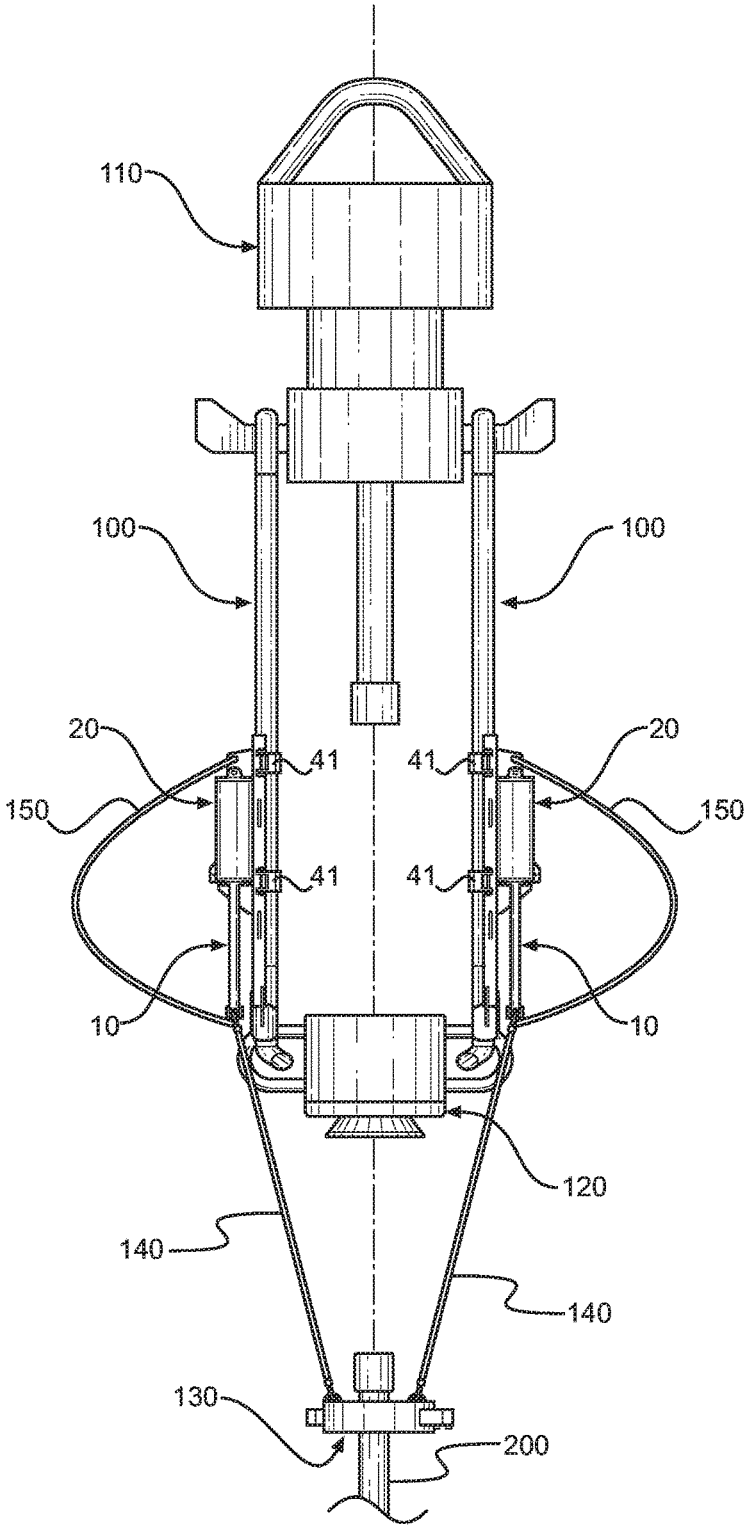
FIG. 7 depicts a front view of the bail assisted pipe stabbing assembly of the present invention installed on a top drive unit of a drilling rig.

FIG. 7 depicts a front view of the bail assisted pipe stabbing assembly of the present invention installed on a top drive unit of a drilling rig. Bail members 100 serve as linkage members between top drive unit 110 and elevators 120. Bail mounting members 10 are mounted to bail members 100, and cables 140 extend from cylinder assemblies 20 of to single joint elevator 130. Single joint elevator 130 is used to grip a section of pipe 200.

In operation, the present invention comprises an integrated mounting system that, once installed, comprises all of the accessories necessary to compensate the weight of a single joint or stand (multiple joints) of tubing, casing or other pipe. The present invention prevents cables and cylinders from becoming tangled within a top drive system, allowing for safer pipe installation (running) or withdrawal (pulling) operations.

Referring to FIG. 7, bail mounting members 10 can be mounted to body section 101 of bail members 100 using clamp members 41. As described above, cup-like support shoulder member 30 generally fits over the upper outer surface of curved loops/eyes of bail members 100. A separate bail mounting member 10 is operationally attached to each bail 100. A cable 140 extends from each piston rod 22 to single joint elevator 130.

Said single joint elevator 130 is lowered into proximity to pipe section 200, typically by lowering top drive unit 110 within a drilling rig derrick. Said pipe section 200 is gripped using said single joint elevator 130. Thereafter, said pipe section 200 can be lifted by raising said top drive unit within a drilling rig derrick, and placed in axial alignment with a string of pipe suspended within a wellbore. Said pipe section 200 can then be lowered within said derrick in order to be connected to the upper threaded connection of a string of pipe extending from a wellbore. If desired, cylinder assemblies 20 and related cables 140 can be attached to their respective bail mounting members 10 using safety cables 150 to prevent any falling objects due to a part failure or inadvertent release; in a preferred embodiment, each safety cable 150 is connected at one end to pad-eye 18 and a part of cylinder assembly (such as piston rod 22) at the other end.

The weight of pipe section 200 is compensated using cylinder assemblies 200, such that the weight of said pipe section 200 does not rest on or impart significant loading on a string of pipe disposed below (and to which pipe section 200 is to be connected). As pipe section 200 is lowered for connection with an underlying string of pipe and the surrounding wellbore (not visible in FIG. 7), the present invention allows for true pipe vertical alignment by maintaining a standard position during makeup and breakout of the threaded pipe sections. The present invention eliminates any excess weight being applied to a threaded connector during makeup or breakout operations, and allows most sizes of tubular products to be made up by hand prior to the installation of tongs.

The present invention is generally compatible with virtually any size bails. In a preferred embodiment, a single cylinder (that is, one cylinder per bail) lifting system eliminates the need to rig up multiple cylinders, such as in a derrick. The mounting of bail mounting members 10 more evenly distributes weight around a bail loop or eye, eliminating any unwanted or inadvertent movement of the present invention during pipe running or pulling operations.

In a preferred embodiment, the present invention uses a three point mounting system with welded mounting bolts and bail hanger clamps which allows for easy rig up and rig down. The present invention can be installed without working from heights or having to kick the bails out to full extension, making for safer rig up and less downtime for installation.

The present invention is described herein primarily in connection with pipe installation operations. However, it is to be observed that the present invention can also be beneficially used in connection with pipe withdrawal or removal operations from a wellbore.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for stabbing of pipe and other tubular goods comprising:

a) a first bail mounting member comprising:
  i) an first elongate body member adapted to operationally attach to a first bail of a drilling rig;
  ii) a first fluid operated cylinder mounted to said elongate body member;

b) a second mounting member comprising:
  i) a second elongate body member adapted to operationally attach to a second bail of a drilling rig;
  ii) a second fluid operated cylinder mounted to said elongate body member;

a) a pipe elevator;

b) a first cable having an upper end and a lower end, wherein said upper end is operationally attached to said first fluid operated cylinder and said lower end is operationally attached to said pipe elevator; and c) a second cable having an upper end and a lower end, wherein said upper end is operationally attached to said second fluid operated cylinder and said lower end is operationally attached to said pipe elevator.

2. The apparatus of claim 1, wherein said fluid operated cylinder compensates for the weight of a section of pipe gripped by said pipe elevator.

3. The apparatus of claim 1, wherein said first elongate body member further comprises an upper end, a lower end and a receptacle disposed at said lower end, wherein said receptacle is adapted to receive a portion of an eye of said first bail.

4. The apparatus of claim 1, wherein said second elongate body member further comprises an upper end, a lower end and a receptacle disposed at said lower end, wherein said receptacle is adapted to receive a portion of an eye of said second bail.

5. The apparatus of claim 1, wherein said pipe elevator is substantially centered over a string of pipe suspended within a wellbore.

6. The apparatus of claim 1, further comprising:

a) a first safety cable extending from said first elongate body member to said first fluid operated cylinder; and b) a second safety cable extending from said second elongate body member to said second fluid operated cylinder.

* * * * *